US007487846B2

(12) United States Patent
Head et al.

(10) Patent No.: US 7,487,846 B2
(45) Date of Patent: Feb. 10, 2009

(54) ELECTRICALLY OPERATED DRILLING METHOD

(75) Inventors: Philip Head, Virginia Water (GB); Paul George Lurie, East Horsley (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 230 days.

(21) Appl. No.: 10/522,116

(22) PCT Filed: Jul. 16, 2003

(86) PCT No.: PCT/GB03/03090

§ 371 (c)(1),
(2), (4) Date: Jan. 24, 2005

(87) PCT Pub. No.: WO2004/011766

PCT Pub. Date: Feb. 5, 2004

(65) Prior Publication Data

US 2005/0252688 A1 Nov. 17, 2005

(30) Foreign Application Priority Data

Jul. 25, 2002 (GB) ..... 0217288.0
Mar. 13, 2003 (GB) ..... 0305811.2

(51) Int. Cl.
*E21B 7/08* (2006.01)

(52) U.S. Cl. ..... 175/61; 175/75

(58) Field of Classification Search ..... 175/61, 175/75

See application file for complete search history.

(56) References Cited

U.S. PATENT DOCUMENTS 4,051,908 A 10/1977 Driver
5,720,356 A * 2/1998 Gardes ..... 175/62
5,921,285 A * 7/1999 Quigley et al. ..... 138/125
6,305,469 B1 * 10/2001 Coenen et al. ..... 166/250.01
6,454,007 B1 * 9/2002 Bailey ..... 166/298

FOREIGN PATENT DOCUMENTS

WO WO 00/75476 A1 12/2000

* cited by examiner

*Primary Examiner*—Jennifer H Gay
*Assistant Examiner*—Nicole Coy
(74) *Attorney, Agent, or Firm*—Jonna Flores; Darla Fonseca; Jaime Castano

(57) ABSTRACT

A method of drilling a borehole from a selected location in an existing wellbore (1) penetrating subterranean earth formation having at least one hydrocarbon bearing zone (3) wherein the existing wellbore is provided with a casing (4) and a hydrocarbon fluid production conduit (6) is arranged in the existing wellbore in sealing relationship with the wall of the casing, the method comprising: passing a remotely controlled electrically operated drilling device (12) from the surface through the hydrocarbon fluid production conduit to the selected location in the existing wellbore; operating the drilling device such that cutting surfaces on the drilling device drill the borehole from the selected location in the existing wellbore thereby generating drill cuttings wherein during operation of the drilling device, a first stream of produced fluid flows directly to the surface through the hydrocarbon fluid production conduit and a second stream of produced fluid is pumped over the cutting surfaces of the drilling device via a remotely controlled electrically operated downhole pumping means and the drill cuttings are transported away from the drilling device entrained in the second stream of produced fluid.

25 Claims, 4 Drawing Sheets

ELECTRICALLY OPERATED DRILLING METHOD

The present invention relates to a method of drilling a borehole from a selected location in an existing wellbore penetrating a subterranean hydrocarbon fluid bearing formation using a remotely controlled electrically operated drilling device wherein the drilling device is introduced into the existing wellbore through a hydrocarbon fluid production conduit and produced fluid, for example produced liquid hydrocarbon and/or produced water is pumped over the cutting surfaces of the drilling device using a remotely controlled electrically operated pumping means to cool the cutting surfaces and to transport drill cuttings away from the drilling device.

In conventional methods of wellbore drilling a drill string including a drill bit at its lower end is rotated in the wellbore while drilling fluid is pumped through a longitudinal passage in the drill string, which drilling fluid returns to surface via the annular space between the drill string and the wellbore wall. When drilling through an earth layer not containing a fluid, the weight and the pumping rate of the drilling fluid are selected so that the pressure at the wellbore wall is kept between a lower level at which the wellbore becomes unstable and an upper level at which the wellbore wall is fractured. When the wellbore is drilled through a hydrocarbon fluid containing zone the drilling fluid pressure should moreover be above the pressure at which hydrocarbon fluid starts flowing into the wellbore, and below the pressure at which undesired invasion of drilling fluid into the formation occurs. These requirements impose certain restrictions to the drilling process, and particularly to the length of the wellbore intervals at which casing is to be installed in the wellbore. For example, if the drilling fluid pressure at the wellbore bottom is just below the upper limit at which undesired drilling fluid invasion into the formation occurs, the drilling fluid pressure at the top of the open-hole wellbore interval can be close to the lower limit at which hydrocarbon fluid influx occurs. The maximum allowable length of the open-hole interval depends on the specific weight of the drilling fluid, the hydrocarbon fluid pressure in the formation, and the height of the drilling fluid column.

Furthermore, it has been practised to drill through a hydrocarbon fluid bearing zone at wellbore pressures below the formation fluid pressure, a methodology commonly referred to as under-balanced drilling. During under-balanced drilling hydrocarbon fluid flows into the wellbore, and consequently the drilling equipment at the surface has to be designed to handle such inflow. Moreover, special measures must be taken to control the fluid pressure in the wellbore during the drilling process.

U.S. Pat. No. 6,305,469 relates to a method of creating a wellbore in an earth formation, the wellbore including a first wellbore section and a second wellbore section penetrating a hydrocarbon fluid bearing zone of the earth formation, the method comprising drilling the first wellbore section; arranging a remotely controlled drilling device at a selected location in the first wellbore section, from which selected location the second wellbore section is to be drilled; arranging a hydrocarbon fluid production tubing in the first wellbore section in sealing relationship with the wellbore wall, the tubing being provided with fluid flow control means and a fluid inlet in fluid communication with said selected location; operating the drilling device to drill the new wellbore section whereby during drilling of the drilling device through the hydrocarbon fluid bearing zone, flow of hydrocarbon fluid from the second wellbore section into the production tubing is controlled by the fluid flow control means. By drilling through the hydrocarbon fluid bearing zone using the remotely controlled drilling device, and discharging any hydrocarbon fluid flowing into the wellbore through the production tubing, it is achieved that the wellbore pressure no longer needs to be above the formation fluid pressure. The wellbore pressure is controlled by controlling the fluid flow control means. Furthermore, no special measures are necessary for the drilling equipment to handle hydrocarbon fluid production during drilling. In case the second wellbore is to be drilled through one or more layers from which no hydrocarbon fluid flows into the wellbore, it is preferred that the drilling device comprises a pump system having an inlet arranged to allow drill cuttings resulting from the drilling action of the drilling device to flow into the inlet, and an outlet arranged to discharge said drill cuttings into the wellbore behind the drilling device. Suitably said outlet is arranged a selected distance behind the drilling device and at a location in the wellbore section where a fluid is circulated through the wellbore, which fluid entrains the drill cuttings and transports the drill cuttings to surface. The second wellbore section can be a continuation of the existing wellbore, or can be a side-track or lateral well (i.e. a branch) of the existing wellbore. It is taught that the drilling device is releasably connected to the lower end of a hydrocarbon production tubing by a suitable connecting device. The hydrocarbon production tubing is then lowered into the casing until the drilling device is near the bottom of the first wellbore section whereafter the production tubing is fixed to the casing by inflating a packer which seals the annular space formed between the production tubing and the casing. Accordingly, there remains a need for a remotely controlled drilling device that uses fluid produced from the formation to transport drill cuttings away from the cutting surfaces of the device wherein the device is capable of being passed from the surface to a selected location in an existing wellbore without having to pull the hydrocarbon fluid production tubing from the wellbore.

Thus, the present invention provides a method of drilling a borehole from a selected location in an existing wellbore penetrating a subterranean earth formation having at least one hydrocarbon fluid bearing zone wherein the existing wellbore is provided with a casing and a hydrocarbon fluid production conduit is arranged in the wellbore in sealing relationship with the wall of the casing, the method comprising:

passing a remotely controlled electrically operated drilling device from the surface through the hydrocarbon fluid production conduit to the selected location in the existing wellbore;

operating the drilling device such that cutting surfaces on the drilling device drill the borehole from the selected location in the existing wellbore thereby generating drill cuttings wherein during operation of the drilling device, a first stream of produced fluid flows directly to the surface through the hydrocarbon fluid production conduit and a second stream of produced fluid is pumped over the cutting surfaces of the drilling device via a remotely controlled electrically operated downhole pumping means and the drill cuttings are transported away from the drilling device entrained in the second stream of produced fluid.

By "produced fluid" is meant produced liquid hydrocarbons and/or produced water, preferably produced liquid hydrocarbons.

An advantage of the process of the present invention is that hydrocarbon fluid may to be produced from the existing wellbore during drilling of the borehole from the selected location. A further advantage of the process of the present invention is that the second stream of produced fluid cools the cutting surfaces of the drilling device in addition to transporting the drill cuttings away from the cutting surfaces.

Yet a further advantage of the present invention is that the method may be used to drill a new wellbore section without having to pull the production conduit from the existing wellbore. It is envisaged that fluid may have been produced from the hydrocarbon fluid bearing zone of the formation prior to passing the remotely controlled electrically operating drilling device through the production conduit to the selected location in the wellbore. However, the method of the present invention may also be used where the existing wellbore has been drilled to a selected location immediately above the hydrocarbon fluid bearing zone of the formation and the new borehole extends the existing wellbore into said hydrocarbon fluid bearing zone. Thus, the new wellbore section may be:

(a) a wellbore extending into the hydrocarbon fluid bearing zone of the formation from a selected location immediately above said zone;

(b) a continuation of an existing wellbore that penetrates the hydrocarbon fluid bearing zone of the formation (c) a side-track well from a selected location in the production tubing or a selected location in the existing wellbore below the production tubing;

(d) a lateral well from a selected location in the production tubing and/or a selected location in the existing wellbore below the production tubing; and (e) a lateral exploration well from a selected location in the production tubing and/or a selected location in the existing wellbore below the production tubing.

By "side-track well" is meant a branch of the existing wellbore where the existing wellbore no longer produces hydrocarbon fluid. Thus, the existing wellbore is sealed below the selected location from which the side-track well is to be drilled, for example, with cement. By "lateral well" is meant a branch of the existing wellbore where the existing wellbore continues to produce hydrocarbon fluid. Suitably, a plurality of lateral wells may be drilled from the existing wellbore. The lateral wells may be drilled from same location in the existing wellbore i.e. in different radial directions and/or from different locations in the existing wellbore i.e. at different depths. By "lateral exploration well" is meant a well that is drilled to explore the formation matrix and formation fluids at a distance from the existing wellbore, as described in more detail below.

Suitably, the casing may be run from the surface to the bottom of the existing wellbore. Alternatively, the casing may be run from the surface into the upper section of the existing wellbore with the lower section of the existing wellbore comprising a barefoot or open-hole completion. Where the selected location in the cased wellbore lies below the production conduit, the borehole formed by the drilling device may be a window in the casing. It is also envisaged that the selected location in the cased wellbore may lie within the production conduit, in which case the borehole formed by the drilling device may be a window through the production conduit and through the casing of the wellbore. The casing of the existing wellbore at the selected location may be formed from metal in which case the cutting surfaces on the drilling device should be capable of milling a window through the casing by grinding or cutting the metal. Thus, the term "drilling device" as used herein encompasses milling devices and the term "drill" encompasses "mill". Alternatively, the casing at the selected location in the existing wellbore may be formed from a friable alloy or composite material such that the window may be milled using a drilling device fitted with a conventional drill bit.

Advantageously, the method of the present invention may also be used to drill through mineral scale that has been deposited on the wall of the existing wellbore and optionally such mineral scale deposited on the wall of the hydrocarbon fluid production conduit thereby enlarging the available borehole in the existing wellbore and, optionally, the available borehole in the production conduit.

Additionally, the method of the present invention may be used to form a perforation tunnel in the casing and cement of the existing wellbore, to remove debris blocking a perforation tunnel or to enlarge a perforation tunnel in the existing wellbore. Suitably, the drilling device employed for forming a new perforation tunnel or for clearing or enlarging an existing perforation tunnel is a micro-drilling device having cutting surfaces sized to form a borehole having a diameter of from 0.2 to 3 inches.

Preferably, the borehole formed by the drilling device in the existing wellbore comprises a new section of wellbore.

Thus, according to a particularly preferred embodiment of the present invention there is provided a method of drilling a section of wellbore from a selected location in an existing wellbore penetrating a subterranean earth formation having at least one hydrocarbon fluid bearing zone wherein the existing wellbore is provided with a casing and a hydrocarbon fluid production conduit is arranged in the wellbore in sealing relationship with the wall of the casing, the method comprising:

passing a remotely controlled electrically operated drilling device from the surface through the hydrocarbon fluid production conduit to a selected location in the existing wellbore, from which selected location the section of wellbore is to be drilled;

operating the drilling device such that cutting surfaces on the drilling device drill the section of wellbore from the selected location in the existing wellbore thereby generating drill cuttings wherein during operation of the drilling device, a first stream of produced fluid flows directly to the surface through the hydrocarbon fluid production conduit and a second stream of produced fluid is pumped over the cutting surfaces of the drilling device via a remotely controlled electrically operated downhole pumping means and the drill cuttings are transported away from the drilling device entrained in the second stream of produced fluid.

An advantage of this preferred embodiment of the present invention is that hydrocarbon fluid may to be produced from the hydrocarbon fluid bearing zone into the existing wellbore during drilling of the new section of wellbore. A further advantage of this preferred embodiment of the present invention is that hydrocarbon fluid may flow from the hydrocarbon fluid bearing zone into the new section of wellbore during the drilling operation.

Preferably, the first stream of produced fluid comprises a major portion of the fluid produced from the hydrocarbon fluid bearing zone of the formation. As discussed above, the produced fluid may comprise produced liquid hydrocarbons and/or produced water, preferably, produced liquid hydrocarbons.

The pressure of the hydrocarbon-bearing zone of the subterranean formation may be sufficiently high that the first stream of produced fluid flows to the surface through the hydrocarbon fluid production conduit by means of natural energy. However, the method of the present invention is also suitable for use in artificially lifted wells. Generally, the entrained cuttings stream may be diluted into the first stream of produced fluid with the cuttings being transported to the surface together with the produced fluid. The cuttings may be removed from the produced fluid at a hydrocarbon fluid processing plant using conventional cuttings separation techniques, for example, using a hydrocyclone or other means for separating solids from a fluid stream. However, it is also envisaged that at least a portion of the cuttings may disentrain from the produced fluid and may be deposited in the rat hole of the existing wellbore. Parameters affecting disentrainment of the cuttings include the flow rate of the first stream of produced fluid, the viscosity of the produced fluid, the density of the cuttings and their size and shape.

Suitably, the drilling device is passed from the surface to the selected location in the existing wellbore suspended on a cable. Preferably, the cable is formed from reinforced steel. The cable may be connected to the drilling device by means of a connector, preferably, a releasable connector. Preferably, the cable encases one or more wires or segmented conductors for transmitting electricity or electrical signals (hereinafter "conventional cable"). The cable may also be a modified "conventional cable" comprising a core of an insulation material having at least one electrical conductor wire or segmented conductor embedded therein, an intermediate fluid barrier layer and an outer flexible protective sheath. Suitably, the intermediate fluid barrier layer is comprised of steel. Suitably, the outer protective sheath is steel braiding. Preferably, the electrical conductor wire(s) and/or segmented conductor(s) embedded in the core of insulation material is coated with an electrical insulation material.

Preferably, the drilling device is provided with an electrically operated steering means, for example, a steerable joint, which is used to adjust the trajectory of the new wellbore section as it is being drilled. This steering means is electrically connected to equipment at the surface via an electrical conductor wire or a segmented conductor embedded in the cable.

Preferably, the existing wellbore has an inner diameter of 5 to 10 inches. Preferably, the production conduit has an inner diameter of 2.5 to 8 inches, more preferably 3.5 to 6 inches. Suitably, the drilling device has a maximum outer diameter smaller than the inner diameter of the production conduit thereby allowing the drilling device to pass through the production conduit and out into the existing wellbore. Preferably, the maximum outer diameter of the drilling device is at least 0.5 inches, more preferably, at least 1 inch less than the inner diameter of the production conduit. The cutting surfaces on the drilling device may be sized to form a new wellbore section having a diameter that is less than the inner diameter of the production conduit, for example, a diameter of 3 to 5 inches. However, the drilling device is preferably provided with expandable cutting surfaces, for example, an expandable drill bit thereby allowing the wellbore that is drilled from the selected location to be of larger diameter than the inner diameter of the production conduit.

Preferably, the drilling device has a first drill bit located at the lower end thereof and a second drill bit located at the upper end thereof. This is advantageous in that the second drill bit may be used to remove debris when withdrawing the drilling device from the wellbore.

Suitably, the drilling device may be provided with formation evaluation sensors which are electrically connected to recording equipment at the surface via the electrical conductor wire(s) or segmented conductor(s) in the cable. Suitably, the sensors are located in proximity to the cutting surfaces on the drilling device.

Optionally, the conventional cable or modified cable from which the drilling device is suspended may be provided with a plurality of sensors arranged along the length thereof. Preferably, the sensors are arranged at intervals of from 5 to 20 feet along the length of the cable. This is advantageous when the drilling device is used to drill a lateral "exploration" well as the sensors may be used to receive and transmit data relating to the nature of the formation rock matrix and the properties of the formation fluids at a distance from the existing wellbore. The data may be continuously or intermittently sent to the surface via the electrical conductor wire(s) and/or segmented conductor(s) embedded in the conventional cable or modified conventional cable. The lateral "exploration" well may be drilled to a distance of from 10 to 10,000 feet, typically up to 2,000 feet from the existing wellbore. The drilling device and associated cable may be left in place in the lateral "exploration well" for at least a day, preferably at least a week, or may be permanently installed in the lateral "exploration" well. Suitably, a plurality of expandable packers are arranged at intervals along the length of the cable. The expandable packers may be used to isolate one of more sections of the lateral "exploration" well thereby allowing data to be transmitted via the cable to the surface relating to the formation conditions in the sealed section(s) of the lateral "exploration" wellbore. Once sufficient information has been obtained from the sealed section of the lateral "exploration" wellbore, the expandable packers may be retracted and at least one new section of the lateral "exploration" wellbore may be isolated and further data may be transmitted to the surface.

Where the borehole formed by the drilling device comprises a new section of wellbore, it is preferred that the cable from which the drilling device is suspended lies within a length of tubing. Suitably, the interior of the tubing is in fluid communication with a fluid passage in the drilling device. The term "passage" as used herein means a conduit or channel for transporting fluid through the drilling device. Suitably, the drilling device is attached either directly or indirectly to the tubing. The tubing extends from the drilling device along at least a lower section of the cable. Preferably, the tubing extends into the hydrocarbon fluid production conduit. Suitably, the length of the tubing is at least as long as the desired length of the new wellbore section. It is envisaged that sensors may be located along the section of cable that lies within the tubing and/or along the outside of the tubing. Where sensors are located on the outside of the tubing, the sensors may be in communication with the electrical conductor wire(s) and/or segmented conductor(s) of the cable via electromagnetic means.

The tubing has an outer diameter smaller than the inner diameter of the production conduit thereby allowing the tubing to pass through the production conduit. As discussed above, the production conduit preferably has an inner diameter of 2.5 to 8 inches, more preferably 3.5 to 6 inches. Preferably, the tubing has an outer diameter that is at least 0.5 inch, more preferably at least 1 inch less than the inner diameter of the production conduit. Typically, the tubing has an outer diameter in the range 2 to 5 inches.

Advantageously, the second stream of produced fluid may be passed to the drilling device through the annulus formed between the tubing and the wall of the new section of wellbore and the cuttings entrained in the second stream of produced fluid (hereinafter "entrained cuttings stream") may be transported away from the drilling device through the interior of the tubing ("reverse circulation" mode). Suitably, the tubing may extend to the surface so that the entrained cuttings stream may be reverse circulated out of the wellbore.

Typically, the tubing may be steel tubing or plastic tubing.

Where the tubing is steel tubing, optionally a housing, preferably a cylindrical housing, may be attached either directly or indirectly to the end of the steel tubing remote from the drilling device, for example, via a releasable connector.

Thus, the drilling device may be attached to a first end of the steel tubing and the housing to a second end of the steel tubing. For avoidance of doubt, the cable passes through the housing and through the steel tubing to the drilling device. An electric motor may be located in the housing and electricity may transmitted to the motor via an electrical conductor wire or segmented conductor encased in the cable. The electric motor may be used to actuate a means for rotating the steel tubing and hence the drilling device connected thereto. Preferably, the housing is provided with electrically operated traction means which may be used to advance the steel tubing and hence the drilling device through the new wellbore section as it is being drilled. Electricity is transmitted to the traction means via an electrical conductor wire or segmented conductor encased in the cable. Suitably, the traction means comprises wheels or pads which engage with and move over the wall of the hydrocarbon fluid production conduit.

As an alternative or in addition to rotating the steel tubing, the drilling device may be provided with an electric motor for actuating a means for driving a drill bit. Typically, the means for driving the drill bit may be a rotor. As discussed above, a drill bit may be located at the lower end of the drilling device and optionally at the upper end thereof. It is envisaged that the upper and lower drill bits may be provided with dedicated electric motors. Alternatively, a single electrical motor may drive both drill bits. Suitably, the electric motor(s) is located in a housing of the drilling device, preferably a cylindrical housing. Electricity is transmitted to the motor(s) via an electrical conductor wire or segmented conductor encased in the cable. The housing of the drilling device may also be provided with an electrically operated traction means which is used to advance the drilling device and steel tubing through the new wellbore section as it is being drilled and also to take up the reactive torque generated by the means for driving the drill bit. Electricity is transmitted to the traction means via an electrical conductor wire or segmented conductor encased in the cable. Suitably, the traction means comprises wheels or pads which engage with and move over the wall of the new wellbore section. It is envisaged that the drilling device may be advanced through the new wellbore section using both the traction means provided on the optional housing attached to the second end of the steel tubing and the tractions means provided on the housing of the drilling device.

As discussed above, the second stream of produced fluid may be drawn to the drilling device through the annulus formed between the steel tubing and the wall of the new section of wellbore and the entrained cuttings stream may be transported away from the drilling device through the interior of the steel tubing ("reverse circulation" mode). Accordingly, the housing of the drilling device is preferably provided with at least one inlet to a first passage in the housing. This first passage is in fluid communication with a second passage and a third passage in the housing of the drilling device. The second passage has an outlet that is in fluid communication with the interior of the steel tubing while the third passage has an outlet in close proximity to the cutting surfaces of the drilling device. Typically, the second stream of produced fluid is drawn through the inlet(s) of the first passage via a pumping means, for example, a suction pump, located in the housing. The second stream of produced fluid is then divided into a first divided fluid stream and second divided fluid stream. The first divided fluid stream flows through the second passage in the housing of the drilling device and into the interior of the steel tubing while the second divided fluid stream flows through the third passage in the housing of the drilling device and out over the cutting surfaces such that the drill cuttings are entrained therein. The resulting entrained cuttings stream is then passed over the outside of the drilling device before being recycled through the inlet(s) of the first passage in the housing of the drilling device. The majority of the cuttings pass into the interior of the steel tubing entrained in the first divided fluid stream. The first divided fluid stream containing the entrained cuttings is discharged from the second end of the steel tubing that is remote from the drilling device, preferably into the hydrocarbon fluid production conduit where the cuttings are diluted into the first stream of produced fluid that flows directly to the surface through the hydrocarbon fluid production conduit.

Alternatively, the second stream of produced fluid may be pumped to the drilling device through the interior of the steel tubing while the entrained cuttings stream may be transported away from the drilling device through the annulus formed between the steel tubing and the wall of the new wellbore section ("conventional circulation" mode). Preferably, the second stream of produced fluid flows from the steel tubing through a passage in the drilling device and out over the cutting surfaces where the produced fluid cools the cutting surfaces and the cuttings become entrained in the produced fluid. The resulting entrained cuttings stream is then transported away from the cutting surfaces over the outside of the drilling device and through the annulus formed between the steel tubing and the wall of the new section of wellbore. It is envisaged the produced fluid flowing from the hydrocarbon fluid bearing zone of the formation into the annulus may assist in transporting the cuttings through the annulus. The second stream of produced fluid may be pumped to the drilling device through the steel tubing via a remotely controlled electrically operated downhole pumping means, for example, a suction pump, located in the housing of the drilling device and/or via a remotely controlled electrically operated pumping means located in the optional housing attached to the second end of the steel tubing that is remote from the drilling device. Preferably, the inlet to the second end of the steel tubing is provided with a filter to prevent any cuttings from being recycled to the drilling device.

The steel tubing may be provided with at least one radially expandable packer, for example, 2 or 3 radially expandable packers, thereby allowing the steel tubing to form a lining for the new wellbore section. When the packer(s) is in its non-expanded state, the steel tubing together with the packer(s) should be capable of being passed through the hydrocarbon fluid production conduit to the selected location of the wellbore from which the new wellbore section is to be drilled. Also, the radially expandable packer(s) should not interfere with the flow of fluid, during the drilling operation, through the annulus formed between the steel tubing and the wall of the new wellbore section. Once the drilling operation is complete, the steel tubing may be locked in place in the new wellbore section by expanding the radially expandable packer(s). Suitably, the steel tubing extends into the hydrocarbon fluid production conduit. Preferably, the upper section of the steel tubing that extends into the production conduit is provided with at least one radially expandable packer(s) such that expansion of the packer(s) seals the annulus formed between the steel tubing and the hydrocarbon fluid production conduit. As an alternative to using expandable packer(s), at least a section of the steel tubing may be provided with an outer coating of a rubber that is swellable when exposed to produced fluids, in particular, hydrocarbon fluids so that the swollen rubber coating forms a seal between the steel tubing and the wall of the new wellbore section. The steel tubing is then perforated to allow produced fluid to flow from the hydrocarbon-bearing zone of the formation into the interior of the steel tubing and into the production conduit.

Alternatively, the steel tubing may be expandable steel tubing. When in its non-expanded state, the steel tubing should be capable of being passed down through the hydrocarbon fluid production conduit of the existing wellbore to the selected location in the existing wellbore from which the new well bore section is to be drilled. Once the drilling operation is complete, the steel tubing may be expanded to form a lining for the new well bore section. Suitably, the expandable steel tubing extends into the hydrocarbon fluid production conduit. The length of the steel tubing which extends into the hydrocarbon fluid production conduit may be expanded against the wall of the production conduit thereby eliminating the requirement for an expandable packer. The steel tubing is then perforated to allow the produced fluid to flow from the hydrocarbon-bearing zone of the formation into the interior of the expanded steel tubing and into the hydrocarbon fluid production conduit. The steel tubing may be expanded by: locking the drilling device in place in the wellbore, for example, using radially extendible gripping means positioned on the housing of the drilling device; detaching the drilling device from the cable and steel tubing; pulling the cable to the surface through the hydrocarbon fluid production conduit and attaching a conventional expansion tool thereto, for example, an expandable mandrel; inserting the expansion tool into the wellbore through the hydrocarbon fluid production conduit and through the steel tubing; and drawing the expansion tool back through the steel tubing to expand the tubing. The drilling device may then be retrieved from the wellbore by: reattaching the cable to the drilling device; retracting the radially extendible gripping means; and pulling the cable and drilling device from the wellbore through the expanded steel tubing and the hydrocarbon fluid production conduit and/or actuating the electrically operatable traction means thereby moving the drilling device through the expanded steel tubing and the production conduit. Alternatively, an electrically operated rotatable expansion tool having radially extendible members may be attached either directly or indirectly to the drilling device, at the upper end thereof. Electricity may be transmitted to the rotatable expansion tool via an electrical conductor wire or segmented conductor encased in the cable. A suitable rotatable expansion tool is as described in U.S. patent application No. 2001/0045284 which is herein incorporated by reference. Suitably, this rotatable expansion tool may be adapted by providing a fluid passage therethrough such that, during the drilling operation, the interior of the steel tubing is in fluid communication with a fluid passage in the drilling device. The rotatable expansion tool may be releasably attached to the expandable steel tubing, for example, via an electrically operated latch means. After completion of drilling of the new wellbore section, the rotatable expansion tool is released from the steel tubing. The rotatable expansion tool is then operated to expand the steel tubing by drawing the expansion tool and the associated drilling device through the steel tubing while simultaneously rotating the expansion tool and extending the radially extendible members. Following expansion of the steel tubing, the rotatable expansion tool and the associated drilling device may be retrieved from the wellbore through the hydrocarbon fluid production conduit by retracting the radially extendible members before pulling the cable and/or actuating the electrically operatable traction means provided on the housing of the drilling device. Where a housing is provided at the end of the steel tubing remote from the drilling device, this housing is preferably released from the steel tubing and is retrieved from the wellbore prior to expanding the steel tubing.

Where the new wellbore section is a lateral well, the portion of the steel tubing which passes through the existing wellbore before entering the hydrocarbon fluid production conduit may be provided with a valve comprising a sleeve which is moveable relative to a section of the steel tubing that has a plurality of perforations therein. When the valve is in its closed position the sleeve will cover the perforations in the section of steel tubing so that produced fluids from the existing wellbore are prevented from entering the hydrocarbon fluid production conduit. When the sliding sleeve is in its open position the plurality of perforations are uncovered and produced fluids from the existing wellbore may pass through the perforations into the steel tubing and hence into the hydrocarbon fluid production conduit.

As discussed above, the tubing may also be plastic tubing. Unlike steel tubing, plastic tubing is deformable under the conditions encountered downhole. Accordingly, the second stream of produced fluid is drawn to the drilling device through the annulus formed between the plastic tubing and the wall of the wellbore and the cuttings stream is transported away from the drilling device through the interior of the tubing ("reverse circulation" mode). Suitably, the second stream of produced fluid is drawn to the drilling device via a pumping means, for example, a suction pump, located in a housing, preferably a cylindrical housing of the drilling device. The pumping means may be operated as described above. Preferably, the housing of the drilling device is provided with an electric motor used to actuate a means for rotating a drill bit located at the lower end of the drilling device, for example, the electric motor may actuate a rotor. Preferably, the housing of the drilling device is provided with an electrically operated traction means, for example, traction wheels or pads which engage with the wall of the new wellbore section and which are used to advance the drilling device through the new wellbore section as it is being drilled and to take up the reactive torque generated by the electric motor used to drive the drill bit. Preferably, the entrained cuttings stream is passed to the surface through the hydrocarbon fluid production conduit together with the first stream of produced fluid. It is also envisaged that at least a portion of the cuttings may be deposited in the rat hole of the existing wellbore, as described above.

Suitably, the plastic tubing lies within a sandscreen which extends along the length of the plastic tubing. The sandscreen may be an expandable sandscreen or a conventional sandscreen. Typically, the sandscreen is attached to the cable and/or to the drilling device, for example, via a releasable latch means. Accordingly, once the new wellbore section has been drilled, the sandscreen may be released from the cable and/or the drilling device. Where the plastic tubing lies within a conventional sandscreen, the drilling device generally has a maximum diameter greater than the inner diameter of the sandscreen. It is therefore envisaged that the drilling device may be released from the cable and the plastic tubing, for example, via an electronically releasable latch means thereby allowing the cable and plastic tubing to be pulled from the wellbore through the interior of the conventional sandscreen and the hydrocarbon fluid production conduit leaving the sandscreen and drilling device in the new wellbore section. Alternatively, the drilling device may be formed from detachable parts wherein the individual parts of the drilling device are sized such that they may be removed from the wellbore through the interior of the conventional sandscreen. Where the sandscreen is an expandable sandscreen, expansion of the sandscreen may allow the drilling device to be retrieved from the wellbore through the expanded sandscreen and the hydrocarbon fluid production conduit. It is envisaged that the expandable sandscreen may be expanded by the steps of:

i. locking the drilling device in place in the wellbore, for example, via radially extendible gripping means, before detaching the drilling device from the cable;

ii. releasing the sandscreen from the cable and/or drilling device;

iii. pulling the cable and associated plastic tubing through the interior of the sandscreen and through the hydrocarbon fluid production conduit;

iv. attaching a conventional tool for expanding a sandscreen to the cable, for example, an expandable mandrel;

v. passing the tool, in its unexpanded state, through the hydrocarbon fluid production conduit and the sandscreen;

vi. drawing the tool, in its expanded state, back through the sandscreen to expand the sandscreen;

vii. retrieving the tool from the wellbore, in its non-expanded state, by pulling the cable through the hydrocarbon fluid production conduit;

viii. retrieving the drilling device from the new section of wellbore by reinserting the cable, reattaching the drilling device to the cable, unlocking the drilling device from the wellbore and pulling the cable and attached drilling device through the expanded sandscreen and through the production tubing and/or by actuating the electrically operatable traction means provided on the housing of the drilling device.

Alternatively, an electrically operated rotatable expansion tool may be attached either directly or indirectly to the drilling device at the upper end thereof. The rotatable expansion tool may also be releasably attached to the expandable sandscreen, for example, via an electrically operated latch means. Electricity is transmitted to the rotatable expansion tool via an electrical conductor wire or segmented conductor encased in the cable. As discussed above, a suitable rotatable expansion tool is as described in U.S. patent application No. 2001/0045284. Suitably, the rotatable expansion tool may be adapted by providing a fluid passage such that, during the drilling operation, the interior of the plastic tubing is in fluid communication with a fluid passage in the drilling device. After completion of drilling of the new wellbore section, the rotatable expansion tool may be released from the sandscreen. The rotatable expansion tool is then operated to expand the sandscreen by drawing the expansion tool and the associated drilling device through the sandscreen while simultaneously rotating the expansion tool and extending the radially extendible members. Following expansion of the sandscreen, the plastic tubing, the rotatable expansion tool and the associated drilling device may be retrieved from the wellbore through the hydrocarbon fluid production conduit by retracting the radially extendible members prior to pulling the cable and/or actuating the electrically operatable traction means provided on the housing of the drilling device.

It is also envisaged that where the plastic tubing is formed from an elastic material, the plastic tubing may be temporarily sealed at its end remote from the drilling device. Produced fluid flowing into the new section of wellbore in the vicinity of the drilling device is then pumped into the interior of the plastic tubing via the pumping means located in the housing of the drilling device. The plastic tubing is thereby expanded radially outwards owing to the pressure of fluid building up in the temporarily sealed interior of the plastic tubing. Thus, the plastic tubing is capable of expanding the sandscreen against the wall of the new wellbore section. Once the sandscreen has been expanded, the fluid pressure in the plastic tubing may be relieved by unsealing the end of the plastic tubing remote from the drilling device. The plastic tubing will then contract radially inwards. The drilling device may then be removed from the wellbore by pulling the cable and associated plastic tubing through the expanded sandscreen and the hydrocarbon fluid production conduit and/or by actuating the electrically operatable traction means provided on the housing of the drilling device.

In yet a further embodiment of the present invention, the drilling device is suspended from tubing having least one electrical conductor wire and/or at least one segmented electrical conductor embedded in the wall thereof (hereinafter "hybrid cable"). Suitably, a passage in the drilling device is in fluid communication with the interior of the hybrid cable. Preferably, the drilling device is connected to the hybrid cable via a releasable connection means.

An advantage of the hybrid cable is that the tubing is provided with at least one electrical conductor wire and/or at least one segmented electrical conductor embedded in the wall thereof for transmitting electricity and/or electrical signals. A further advantage of the hybrid cable is that the second stream of produced fluid may be passed to the drilling device through the annulus formed between the tubing and the wall of the new section of wellbore and the entrained cuttings stream may be transported away from the drilling device through the interior of the tubing ("reverse circulation" mode). Alternatively, the second stream of produced fluid may be passed to the drilling device through the interior of the hybrid cable while the entrained cuttings stream may be transported away from the drilling device through the annulus formed between the hybrid cable and the wall of the new wellbore section ("conventional circulation" mode).

Suitably, the hybrid cable may extend to the surface which has an advantage of allowing the entrained cuttings stream to be reverse circulated out of the well when the drilling device is operated in reverse circulation mode. Alternatively, the hybrid cable may be suspended from a further cable via a connection means, preferably, a releasable connection means. Suitably, the further cable is a conventional cable or a modified conventional cable of the type described above. The connection means is suitably provided with at least one electrical connector for connecting the electrical conductor wire(s) or the segmented electrical conductor(s) of the conventional cable or modified conventional cable with the corresponding electrical conductor wire(s) or segmented electrical conductor(s) of the hybrid cable. Preferably, the hybrid cable has a length that is at least as long as the desired new wellbore section. Typically, the hybrid cable extends into the hydrocarbon fluid production conduit. Suitably, the interior of the hybrid cable is in fluid communication with the passage in the drilling device and with a passage in the connection means.

Preferably, the wall of the hybrid cable is comprised of at least four layers. The layers from the inside to the outside of the hybrid cable comprise: a metal tube suitable for conveying hydrocarbon fluids therethrough, a flexible insulation layer having the electrical conductor wire(s) and/or segmented electrical conductor(s) embedded therein, a fluid barrier layer and a flexible protective sheath.

Preferably, the internal diameter of the inner metal tube of the hybrid cable is in the range 0.2 to 5 inches, preferably 0.3 to 1 inches. Preferably, the inner metal tube is formed from steel. Preferably, the flexible insulation layer is comprised of a plastic or rubber material. Preferably, the fluid barrier layer is comprised of steel. Preferably, the flexible protective sheath is comprised of steel braiding. Suitably, the electrical conductor wire(s) and/or segmented electrical conductor(s) embedded in the flexible insulation layer are coated with an electrical insulation material.

Preferably, the drilling device that is connected to the hybrid cable comprises a housing that is provided with an electrically operated pumping means, an electric motor for actuating a means for driving a drill bit or mill located at the lower end of the drilling device and an electrically operated traction means. Optionally, the housing is provided with an electric motor for actuating a means for driving a drill bit or mill located at the upper end of the drilling device. As discussed above, it is envisaged that a single electric motor may actuate both of the drive means. Alternatively, each drive means may be provided with a dedicated electric motor.

Where produced fluid flows from the hydrocarbon fluid bearing zone of the formation into the new wellbore section there may be no requirement for any tubing or for a hybrid cable. Thus, the drilling device may comprise a housing provided with an electric motor for actuating a means for driving a drill bit or mill located on the lower end of the drilling device. Optionally, the housing is provided with an electric motor for actuating a means for driving a drill bit or mill located at the upper end of the drilling device. As discussed above, it is envisaged that the housing may be provided with a single electric motor for actuating both of the drive means. An electrically operated pumping means, for example, a suction pump, may also be located in the housing of the drilling device. The drilling device, suspended on a conventional or modified conventional cable, may then be passed to the selected location in the existing wellbore from which the new wellbore section is to be drilled. As the new wellbore section is being drilled, the pumping means located in the housing of the drilling device draws produced fluid flowing from the hydrocarbon fluid bearing zone of the reservoir into the new wellbore section through a passage in the drilling device ("second stream of produced fluid") and out over the cutting surfaces of the drill bit or mill. The resulting entrained cuttings stream then flows around the outside of the drilling device and is diluted into produced fluid that is flowing to the surface through the production conduit. ("first stream of produced fluid"). Where the new wellbore section is a side-track or lateral wellbore, it is also envisaged that at least a portion of the cuttings may disentrain from the produced fluid and may be deposited in the rat hole of the existing wellbore, as described above.

Where the new wellbore section is a side-track or lateral well and the existing wellbore is provided with a casing which runs down through the selected located where the new wellbore section is to be drilled, it is generally necessary to mill a window through the casing before commencing drilling of the new wellbore section. Where the side-track or lateral well is to be drilled from a location in the production conduit, the window is milled through the production conduit and through the casing before commencing drilling of the new wellbore section. Where the casing and optionally the production conduit is formed from metal, this may be achieved by lowering a whipstock to the selected location through the hydrocarbon fluid production conduit. Suitably, the whipstock may be lowered to the selected location in the wellbore suspended from a cable, for example, a conventional cable or a modified conventional cable, via a releasable connection means. The whipstock is then locked in place in the casing or the production conduit via radially extendible gripping means, for example radially extendible arms. The whipstock is then released from the cable and the cable is pulled from the wellbore. A first drilling device comprising a mill is subsequently lowered to the selected location in the wellbore suspended from a cable, for example, a conventional cable, modified conventional cable or a hybrid cable. However, it is also envisaged that the whipstock may be lowered to the selected location suspended from the first drilling device which, in turn, is suspended from a cable, for example, a conventional cable, a modified conventional cable or a hybrid cable. Suitably, the whipstock may be suspended from the first drilling device via a releasable connection means. Once the whipstock is located in the region of the cased wellbore where it is desired to drill the side-track or lateral well, the whipstock is locked into place in the casing or the production conduit as described above. The whipstock is then released from the first drilling device. By whipstock is meant a device having a plane surface inclined at an angle relative to the longitudinal axis of the wellbore which causes the first drilling device to deflect from the original trajectory of the wellbore at a slight angle so that the cutting surfaces of the mill engage with and mill a window through the metal casing of the wellbore (or through the metal production conduit and the metal casing). Preferably, the first drilling device is provided with an electrically operated traction means to assist in the milling operation. Once a window has been milled through the metal casing (or through the metal production conduit and the metal casing), the first drilling device may be removed from the wellbore by pulling the cable out of the wellbore and/or by operating the traction means. A second drilling device comprising a conventional drill bit is then attached to the cable which is reinserted into the wellbore through the hydrocarbon fluid production conduit. Where the cable is a conventional cable or modified conventional cable, it is preferred that the cable passes through a length of tubing which is in fluid communication with a fluid passage in the drilling device, as described above. The whipstock causes the second drilling device to deflect into the window in the casing (or the window in the production conduit and casing) such that operation of the second drilling device results in the drilling of a side-track or lateral well through the hydrocarbon-bearing zone of the formation. However, it is also envisaged that the casing (or the production conduit and casing) at the selected location of the wellbore may be formed from a friable alloy or composite material such that a window may be formed in the casing (or the production conduit and casing) using a drilling device comprising a conventional drill bit and the drilling device may then be used to drill the side-track or lateral well.

Where a whipstock is employed to deflect the drilling device, the whipstock may remain in the existing wellbore following completion of drilling of the new wellbore section. Where the new wellbore is a lateral well, the whipstock is provided with a fluid by-pass to allow produced fluid to continue to flow to the surface from the existing wellbore through the hydrocarbon fluid production conduit. Preferably, the whipstock is retrievable through the production conduit. Thus, the whipstock may be collapsible, for example, has retractable parts and is capable of being retrieved through the hydrocarbon fluid production conduit when in its collapsed state, for example, by attaching a cable thereto and pulling the cable from the wellbore through the hydrocarbon fluid production conduit.

In yet a further embodiment of the present invention there is provided a method of removing deposits of mineral scale, for example, deposits of barium sulfate and/or calcium carbonate from the wall of the existing wellbore, for example, from the wall of the casing of a cased wellbore thereby increasing the diameter of the available bore hole. Thus, the drilling device may be lowered into the wellbore through the hydrocarbon production conduit suspended on a conventional cable, a modified conventional cable or a hybrid cable to a section of the existing wellbore having mineral scale deposited on the wall thereof. Optionally, the drilling device may be used to remove mineral scale deposits from the wall of the production conduit as the drilling device is being lowered into the wellbore through the production conduit. Suitably, the cuttings of mineral scale are diluted into the first stream of produced fluid that flows from the formation directly to the surface. Preferably, the drilling device that is used to remove mineral scale from the wall of the existing wellbore or from the production conduit is provided with upper and lower cutting surfaces. Thus, a drill bit or mill may be located on both the upper and lower ends of the drilling device. Preferably, the drill bit or mill that is located on the upper end of the device is positioned on the housing below a connector for the cable. By providing a drill bit or mill on the upper end of the device, the mineral scale deposit may be removed from the wall of the existing wellbore upon raising the drilling device through the wellbore in addition to when lowering the device through the wellbore suspended on the cable. Preferably, an electrically operated traction means is provided below the upper drill bit or mill to assist in moving the drilling device upwardly through the wellbore. It is envisaged that the drilling device may be moved upwardly and downwardly within the wellbore a plurality of times, for example, 2 to 5 times, in order to substantially remove the mineral scale deposit from the wall of the existing wellbore, for example, from the wall of the casing of a cased wellbore. Preferably, the drill bit or mill located on the lower end of the drilling device and optionally on the upper end of the drilling device is an expandable drill bit. This is advantageous when the drilling device is used to remove mineral scale deposits from the wall of a cased wellbore as the diameter of the wellbore is generally significantly larger than the inner diameter of the production conduit. Preferably, the drilling device may also be moved, a plurality of times, upwardly and downwardly within the production conduit in order to substantially remove mineral scale deposits from the production conduit. Preferably, the device is left in the wellbore below a producing interval and is deployed, as required, to remove any mineral scale deposits that may build up on the wall of the existing wellbore and optionally on the wall of the production conduit. Suitably, the mineral scale cuttings are removed from the produced fluid at the wellhead, using conventional cuttings separation techniques. However, it is also envisaged that at least a portion of the mineral scale cuttings may disentrain from the produced fluid and may be deposited in the rat hole of the existing well, as described above.

In yet a further embodiment of the present invention there is provided a method of removing debris from a perforation tunnel formed in the casing and cement of a cased wellbore or of enlarging such a perforation tunnel using a remotely controlled electrically operated micro-drilling device. The micro-drilling device comprises a housing provided with an electrically operated motor for actuating a means for driving a drill bit. The drill bit is mounted on an electrically or hydraulically actuated thruster means. Where the thruster means is hydraulically actuated, the housing is provided with a reservoir of hydraulic fluid. An electrically operated pumping means is also located within the housing of the micro-drilling device. Suitably, the motor for actuating the means for driving the drill bit has a maximum power of 1 kw. The drill bit is sized to form boreholes having a diameter in the range 0.2 to 3 inches, preferably, 0.25 to 1 inches. The micro-drilling device is suspended on a cable via a releasable connector and is passed from the surface through the hydrocarbon fluid production conduit to a selected location is the existing wellbore containing the perforation tunnel from which debris is to be removed or which is to be enlarged. The cable may be a conventional cable, modified conventional cable or hybrid cable. The micro-drilling device may be orientated adjacent the perforation with the drill bit aligned with the perforation tunnel, for example, by using a stepper motor located at the upper end of the micro-drilling device. The stepper motor allows the micro-drilling device to rotate about its longitudinal axis while the connector and cable remain stationary. The micro-drilling device may then be locked in place in the cased wellbore via radially extendible gripping means, for example, hydraulic rams which, when extended, engage with the wall of the wellbore. During the drilling operation, a produced fluid stream is pumped through a first passage in the micro-drilling device and out over the cutting surfaces of the drill bit via the pumping means. An entrained cuttings stream is transported away from the cutting surfaces, for example through a second passage in the micro-drilling device. The thruster means provides a thrusting force to the drill bit such that the drill bit moves through the perforation tunnel. An advantage of this further embodiment of the present invention is that any produced fluids flowing from the formation through the perforation tunnel into the wellbore will assist in transporting the drill cuttings out of the perforation tunnel. The micro-drilling device may additionally comprise a mill that is mounted on a thruster means and an electric motor for actuating a means for rotating the mill thereby allowing the micro-drilling device to form a new perforation tunnel at a selected location in the cased wellbore. Suitably, the thruster means provides a force to the mill so that a perforation is milled through the casing at the selected location. Suitably the mill is sized such that the perforation has a diameter of 1 to 3 inches. After milling through the metal casing, the drill bit may then be positioned in the perforation to complete the perforation tunnel.

BRIEF DESCRIPTION OF DRAWINGS

The present invention will now be illustrated by reference to FIGS. 1 to 5. Referring to FIG. 1, an existing wellbore 1 penetrates through an upper zone 2 of a subterranean formation and into a hydrocarbon-bearing zone 3 of the subterranean formation located below the upper zone 2. A metal casing 4 is arranged in the existing wellbore 1 and is fixed to the wellbore wall by a layer of cement 5. A hydrocarbon fluid production conduit 6 is positioned within the existing wellbore 1 and a packer 7 is provided at the lower end of the casing 4 to seal the annular space formed between the conduit 6 and the casing 4. A wellhead 8 at the surface provides fluid communication between the conduit 6 and a hydrocarbon fluid production facility (not shown) via a pipe 9. An expandable whipstock 10 is passed through the conduit 6 and is locked in place in the casing 4 of the existing wellbore 1 via radially expandable locking means 11. A remotely controlled electrically operated drilling device 12 is passed into the existing wellbore through the hydrocarbon fluid production conduit 6 suspended on a reinforced steel cable 13 comprising at least one electrical conductor wire or segmented conductor (not shown). The lower end of the reinforced steel cable 13 passes through a length of steel tubing 14 which is in fluid communication with a fluid passage (not shown) in the drilling device 12. The drilling device 12 is provided with an electrically operated steering means, for example, a steerable joint (not shown) and an electric motor (not shown) arranged to drive a means (not shown) for rotating drill bit 15 located at the lower end of the drilling device 12. A cylindrical housing 16 is attached to the upper end of the steel tubing 14. The drilling device 12 and/or the housing 16 are provided with an electrically operated pump (not shown) and electrically operated traction wheels or pads 17 which are used to advance the drilling device 12 through a new wellbore section 18. For avoidance of doubt, the cable 13 passes through the housing 16 and the interior of the steel tubing 14 to the drilling device 12.

Figure 1:
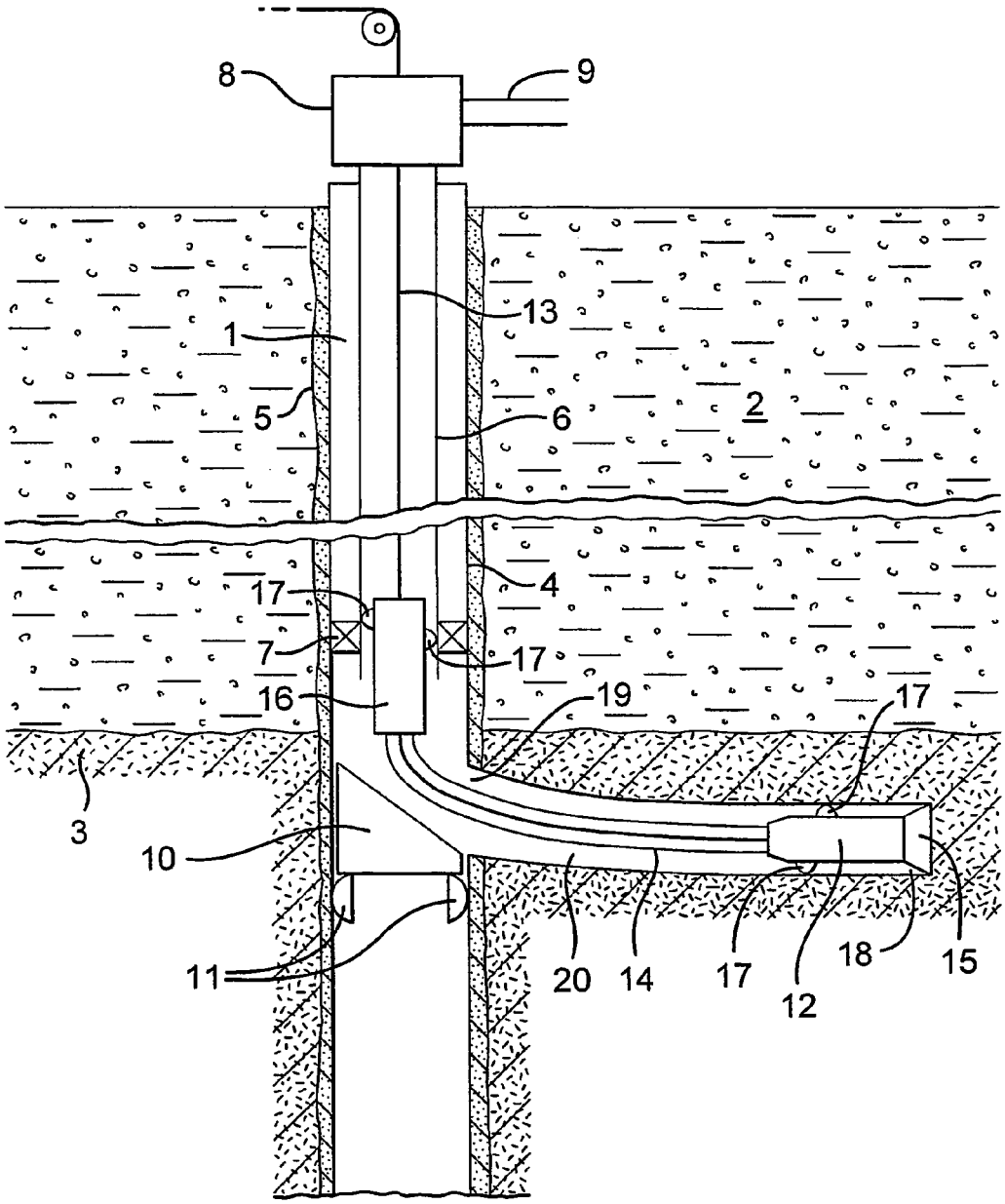
FIG. 1 is a schematic drawing of a remotely controlled electrically operated drilling device during drilling.

The new wellbore section 18 is drilled using the drilling device 12 in the manner described hereinafter, the new wellbore section extending from a window 19 in the casing 4 of the existing wellbore 1 into the hydrocarbon-bearing zone 3 and being a side-track well or lateral well. The window 19 may have been formed using a drilling device comprising a mill which is passed through the production conduit 6 suspended on a cable and is then pulled from the existing wellbore. During drilling of the new wellbore section 18, produced fluid may be pumped down the interior of the steel tubing 14 to the drilling device 12 via a pump located in the cylindrical housing 16. The produced fluid flows from the steel tubing 14 through the fluid passage in the drilling device to the drill bit 15 where the produced fluid serves both to cool the drill bit 15 and to entrain drill cuttings. The drill cuttings entrained in the produced fluid are then passed around the outside of the drilling device 12 into the annulus 20 formed between the steel tubing 14 and the wall of the new wellbore section 18 ("conventional circulation" mode). Alternatively, produced fluid may be pumped through the annulus 20 to the drill bit 15. The drilling cuttings entrained in the produced fluid are then passed through the passage in the drilling device and into the interior of the steel tubing 14 ("reverse circulation" mode).

A plurality of formation evaluation sensors (not shown) may be located: on the drilling device 12 in close proximity to the drill bit 15; on the end of the steel tubing 14 which is connected to the drilling device 12; along the lower end of the cable 13 that lies within the steel tubing 14; or along the outside of the steel tubing. The formation evaluation sensors are electrically connected to recording equipment (not shown) at the surface via electrical wire(s) and/or segmented conductor(s) which extend along the length of the cable 13. Where sensors are located on the outside of the steel tubing, the sensors may be in communication with the electrical wire(s) and/or segmented conductor(s) of the cable 13 via electromagnetic means. As drilling with the drilling device 12 proceeds, the formation evaluation sensors are operated to measure selected formation characteristics and to transmit signals representing the characteristics via the electrical conductor wire(s) and/or segmented conductor(s) of the cable 13 to recording equipment at the surface (not shown).

A navigation system (not shown) for the steering means may also be included in the drilling device 12 to assist in navigating the drilling device 12 through the new wellbore section 18.

After drilling of the new wellbore section 18, the steel tubing 14 may be expanded to form a liner for the new wellbore section 18 and the drilling device 12 may be retrieved by pulling the cable from the wellbore and/or by actuating the traction wheels or pads 17 such that the drilling device passes through the expanded steel tubing and the hydrocarbon fluid production conduit 6.

Where the steel tubing is not expandable, the steel tubing may be provided with at least one radially expandable packer. The packer(s) may be expanded to seal the annulus formed between the steel tubing 14 and the new wellbore section 18 thereby forming a sealed liner for the new wellbore section 18. Where a pump is located in the housing of the drilling device 12, this pump may be disconnected from the housing and may be retrieved through the interior of the steel tubing 14.

The liner for the new wellbore section is then perforated to allow hydrocarbons to flow through the interior thereof into the production conduit 6.

Figure 2:
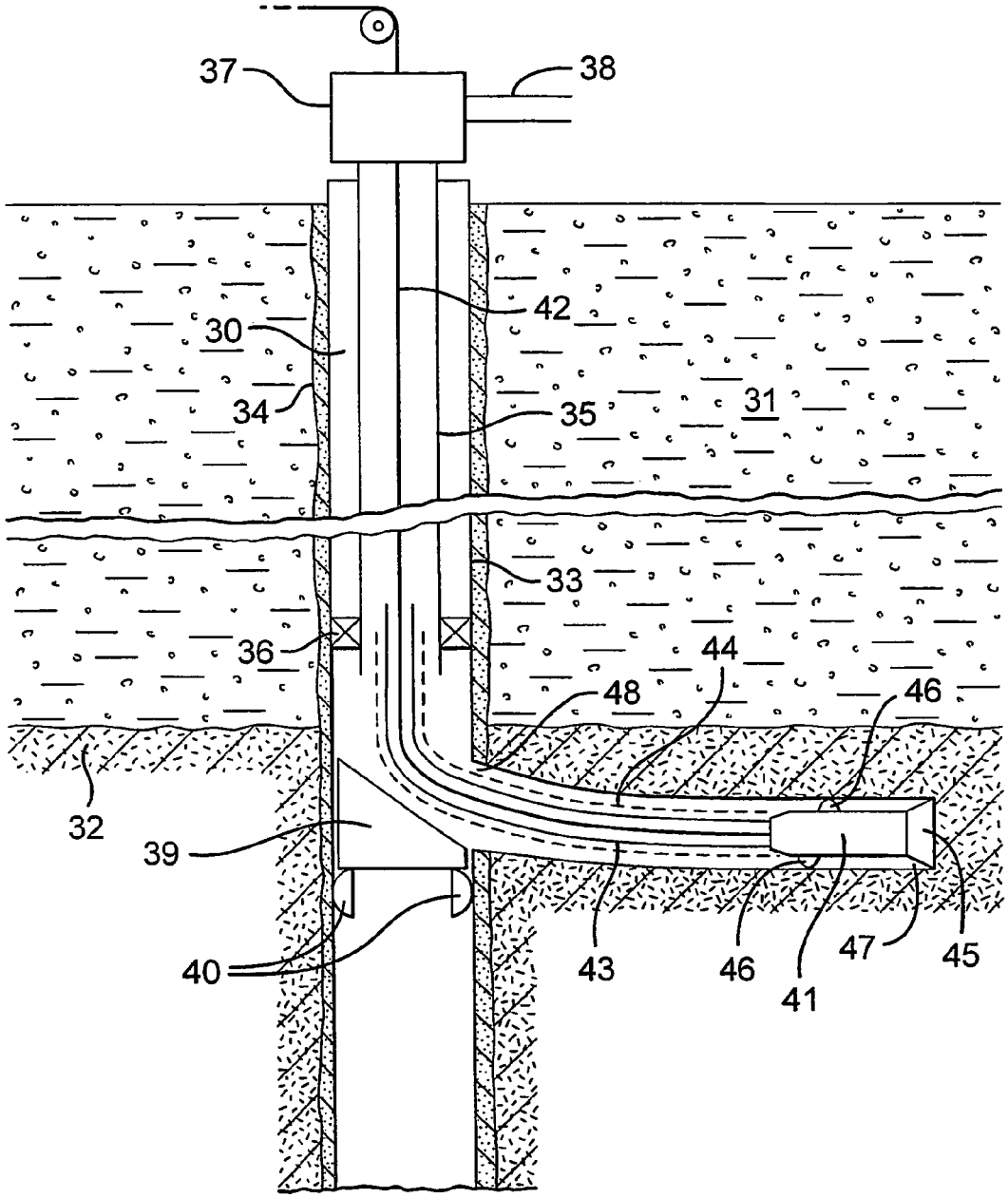
FIG. 2 is a schematic drawing of a remotely controlled electrically operated drilling device during production.

Referring to FIG. 2, an existing wellbore 30 penetrates through an upper zone 31 of the subterranean formation into a hydrocarbon-bearing zone 32 of the subterranean formation located below the upper zone 31. A metal casing 33 is arranged in the existing wellbore 30 and is fixed to the wellbore wall by a layer of cement 34. A hydrocarbon fluid production conduit 35 is positioned within the existing wellbore 30 and is provided at its lower end with a packer 36 which seals the annular space between the conduit 35 and the casing 33. A wellhead 37 at the surface provides fluid communication between the hydrocarbon fluid production conduit 35 and a hydrocarbon fluid production facility (not shown) via a pipe 38. An expandable whipstock 39 is passed down the conduit 6 and is locked in place in the existing wellbore via radially expandable locking means 40. A remotely controlled electrically operated drilling device 41 is passed into the existing wellbore through the hydrocarbon fluid production conduit suspended on a reinforced steel cable 42 comprising at least one electrical conductor wire or segmented conductor (not shown). The lower end of the reinforced steel cable 42 passes through a length of plastic tubing 43 which is in fluid communication with a fluid passage (not shown) in the drilling device 41. The plastic tubing 43 passes through an expandable sandscreen 44 which is releasably connected to the drilling device 41. The drilling device 41 is provided with an electrically operated pumping means (not shown), an electrically operated steering means, for example, a steerable joint (not shown) and an electric motor (not shown) arranged to drive a drill bit 45 located at the lower end of the drilling device 41. The drilling device 41 is also provided with electrically operated traction wheels or pads 46 for advancing the drilling device 41 though a new wellbore section 47 as it is being drilled or for retrieving the drilling device 41 from the wellbore.

A new wellbore section 47 is drilled using the drilling device 41 in the manner described hereinafter, the new wellbore section extending from a window 48 in the casing 34 of the existing wellbore 30 into the hydrocarbon-bearing zone 32 and being a side-track well or lateral well. The window may be formed using a drilling device comprising a mill which is passed through the production conduit suspended on a cable and which is then retrieved from the existing wellbore by pulling the cable. During drilling of the new wellbore section 47, produced fluid is drawn down the annulus formed between the sandscreen 44 and the wall of the new wellbore section to the drilling device 41 and the cuttings entrained in the produced fluid are transported away from the drilling device 41 through the interior of the plastic tubing 43.

As discussed above, a plurality of formation evaluation sensors (not shown) may be located: on the drilling device 41 in proximity to the drill bit 45; on the end of the plastic tubing 43 which is connected to the drilling device 41; along the cable 42; or on the outside of the plastic tubing 43.

Also, as discussed above, a navigation system (not shown) for the steering means may be included in the drilling device 41 to assist in navigating the drilling device 41 through the new wellbore section 47.

After drilling of the new wellbore section 47, the sandscreen 44 may be expanded, for example, by sealing the plastic tubing and pumping produced fluid into the interior of the plastic tubing to expand the tubing. The plastic tubing may then be retracted by unsealing the tubing. The drilling device 41 may then be retrieved by pulling the cable 42 and retracted plastic tubing 43 from the wellbore through the expanded sandscreen 44 and the hydrocarbon fluid production conduit 35 and/or by actuating the traction wheels or pads 46.

Figure 3:
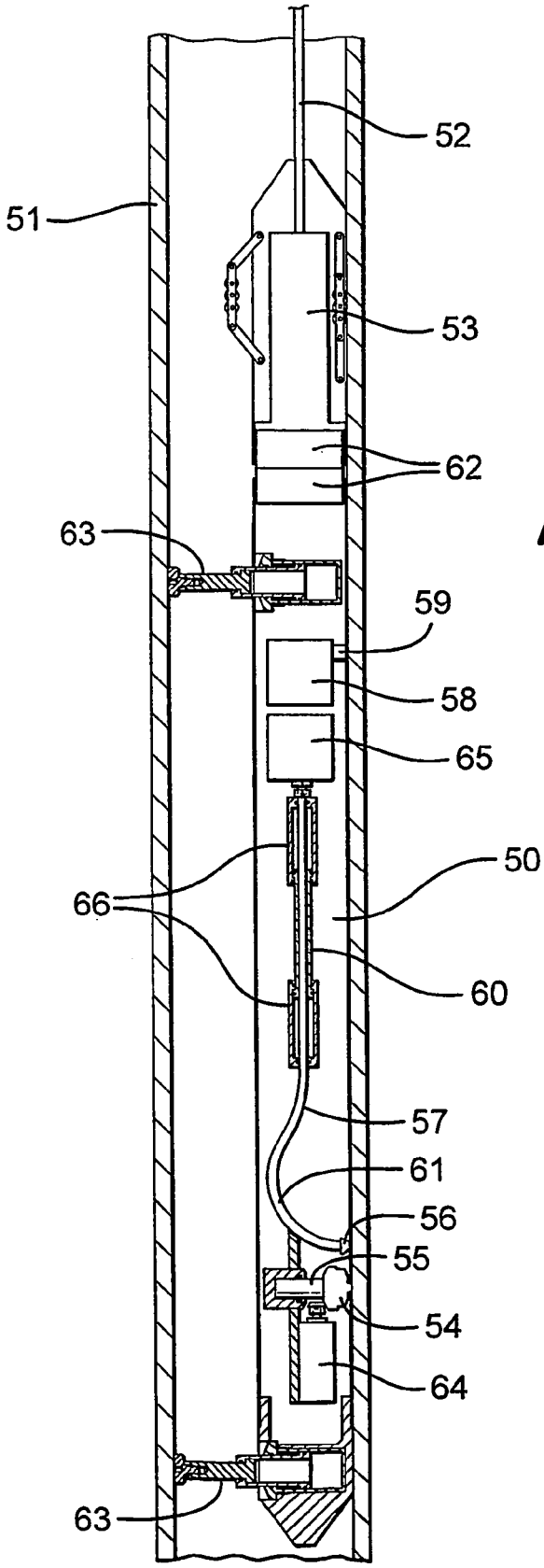
FIG. 3 illustrates a remotely controlled electrically operated micro-drilling device according to a preferred aspect of the present invention.

FIG. 3 illustrates a remotely controlled electrically operated micro-drilling device 50 according to a preferred aspect of the present invention. The remotely controlled electrically operated micro-drilling device 50 is passed into an existing cased wellbore 51 through a hydrocarbon fluid production conduit (not shown) suspended on a cable 52 via a connector 53. The cable 52 comprises at least one electrical conductor wire or segmented conductor (not shown) and may be a conventional cable, a modified conventional cable or a hybrid cable of the types described above. The micro-drilling device 50 is provided with a mill 54 mounted on a hydraulic piston 55 and a drill bit 56 located at the end of a flexible rotatable drive tube 57. A pump 58 is in fluid communication with the produced fluids in the wellbore via an inlet 59 and with the interior of the flexible rotatable drive tube 57. The drive tube 57 is arranged within a telescopic support tube 60 such that an annular space is formed between the drive tube and the support tube. The concentrically arranged drive tube 57 and support tube 60 pass through a guide tube 61 thereby orientating the drill bit 56.

During operation of the micro-drilling device, a stepper motor 62 is used to rotate the micro-drilling device 50, about its longitudinal axis, relative to the connector 53. Once the micro-drilling device 50 has been orientated in the wellbore, it is locked in place against the casing of the wellbore via hydraulic rams 63. The mill is then rotated via a first electric drive 64 while hydraulic piston 55 provides a thrust force to the mill 54 so that a perforation is milled through the casing. After the milling operation has been completed, the drill bit 56 is aligned with the perforation and the drilling device is locked in place in the wellbore using the hydraulic rams 63. The drive tube 57 and hence the drill bit 56 is then rotated by means of a second electric drive 65. During the drilling operation, produced fluid is drawn from the wellbore through the inlet 59, via the pump 58, and is passed through the interior of the drive tube 57 to the drill bit 56 while cuttings entrained in the produced fluid are carried away from the drill bit 56 via the annulus formed between the drive tube 57 and the telescopic support tube 60. A thrust force is provided to the drill bit 56 through actuation of further hydraulic rams 66 which drive telescopic sections of the support tube 60 together such that at least one section of the support tube slides into another section of the support tube.

Figure 4:
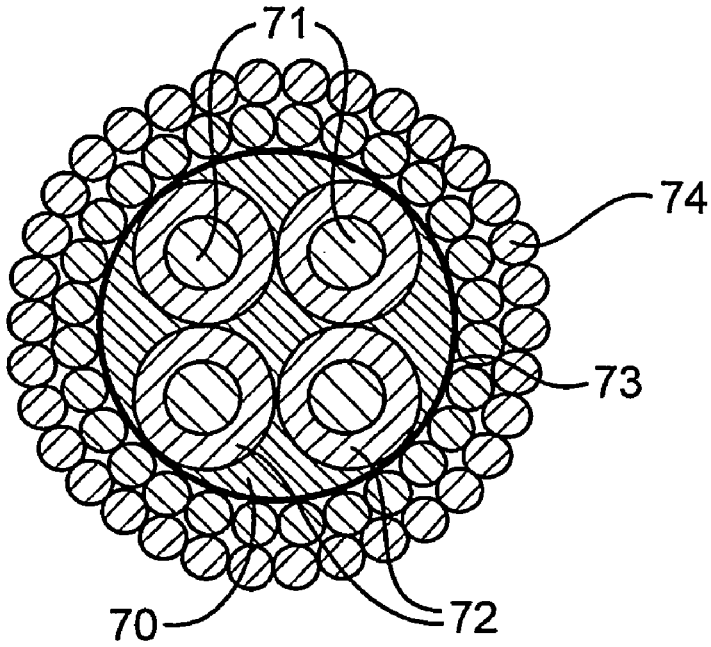
FIG. 4 illustrates a transverse cross-section of a modified conventional cable.

FIG. 4 illustrates a transverse cross-section of a modified "conventional cable" comprising a core of an insulation material 70 having electrical conductor wires 71 coated with electrical insulation material 72 embedded therein; a fluid barrier layer 73; and steel braiding 74.

Figure 5:
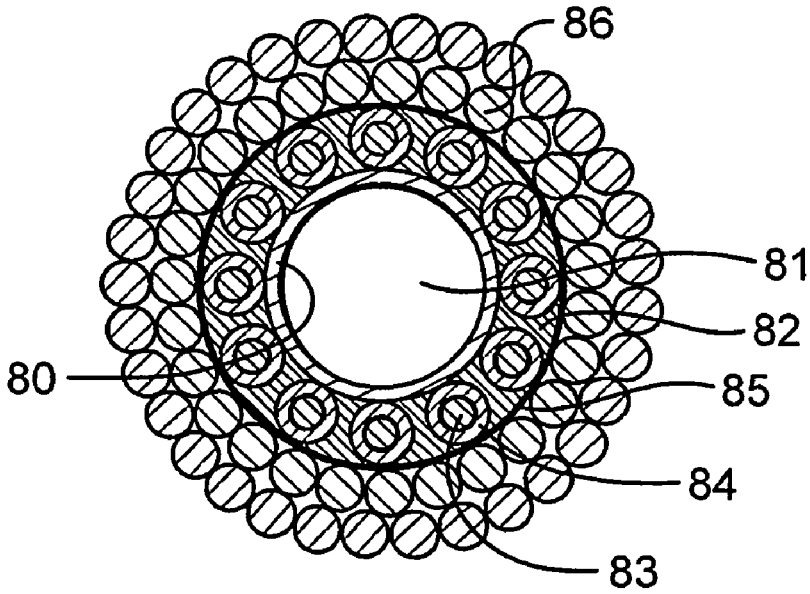
FIG. 5 illustrates a transverse cross-section of a hybrid cable.

FIG. 5 illustrates a transverse cross-section of a "hybrid cable" comprising an inner metal tube 80 suitable for conveying hydrocarbon fluids through the interior 81 thereof; a flexible insulation layer 82 having electrical conductor wires 83 coated with an electrical insulation material 84 embedded therein; a fluid barrier layer 85; and steel braiding 86.

The invention claimed is:

1. A method of drilling a borehole from a selected location in an existing wellbore penetrating a subterranean earth formation having at least one hydrocarbon bearing zone wherein the existing wellbore is provided with a casing and a hydrocarbon fluid production conduit is arranged in the existing wellbore in sealing relationship with the wall of the casing, the method comprising:

passing a remotely controlled electrically operated drilling device suspended on a cable that encases at least one wire and/or segmented conductor for transmitting electricity or electrical signals, from the surface through the hydrocarbon fluid production conduit to the selected location in the existing wellbore;

operating the drilling device such that cutting surfaces on the drilling device drill a new wellbore section from the selected location in the existing wellbore thereby generating drill cuttings wherein at least a lower section of the cable from which the drilling device is suspended lies within a length of tubing having a first end that is in fluid communication with a fluid passage in the drilling device and a second end that extends into the hydrocarbon fluid production conduit and wherein during operation of the drilling device, a first stream of produced fluid flows directly to the surface through the hydrocarbon fluid production conduit and a second stream of produced fluid is pumped over the cutting surfaces of the drilling device via a remotely controlled electrically operated downhole pumping means and the drill cuttings are transported away from the drilling device entrained in the second stream of produced fluid.

2. A method as claimed in claim 1 wherein the existing wellbore has an upper cased section and a lower uncased section.

3. A method as claimed in claim 1 wherein the cutting surfaces of the drilling device are located on a drill bit or mill that is provided at or near the lower end of the drilling device and optionally on a drill bit or mill that is provided at or near the upper end of the drilling device.

4. A method as claimed in claim 3 wherein the drill bit or mill is expandable thereby allowing the borehole that is drilled from the selected location to be of a larger diameter than the inner diameter of the production conduit.

5. A method as claimed in claim 3 wherein the drilling device is provided with an electrically operated steering means for the drill bit or mill.

6. A method as claimed in claim 3 wherein the drilling device is provided with an electric motor for actuating a means for driving the drill bit or mill.

7. A method as claimed in claim 1 wherein the drilling device is provided with the electrically operated pumping means.

8. A method as claimed in claim 1 wherein the drilling device is provided with an electrically operated traction means.

9. A method as claimed in claim 1 wherein the borehole that is drilled from the selected location is (a) a new section of wellbore; (b) a window in the casing of the existing wellbore or a window in the production conduit and casing of the existing wellbore; (c) a perforation tunnel in the casing and cement of the existing wellbore; or (d) an enlarged borehole through at least a section of the existing wellbore having mineral scale deposited on the wall thereof.

10. A method as claimed in claim 9 for drilling a side-track or lateral well comprising:

passing a whipstock having radially extendable gripping means from the surface through the hydrocarbon fluid production conduit to the selected location in the casing or production conduit of the existing wellbore;

locking the whipstock into place either in the casing of the existing wellbore or in the production conduit by radially extending the gripping means;

lowering a first drilling device comprising a mill suspended from a cable, through the hydrocarbon production conduit to the selected location;

deflecting the first drilling device against the whipstock such that the cutting surfaces of the mill engage with the casing or production conduit;

operating the first drilling device such that a window is milled through the casing of the wellbore or through the production conduit and casing of the wellbore;

removing the first drilling device from the wellbore;

lowering a second drilling device comprising a drill bit, suspended from a cable, through the hydrocarbon fluid production conduit to the selected location;

deflecting the second drilling device against the whipstock into the window in the casing or the window in the production conduit and casing; and operating the second drilling device such that the culling surfaces of the drill bit drill a side-track or lateral well through the hydrocarbon-bearing zone of the formation.

11. A method as claimed in claim 10 wherein the whipstock is passed to the selected location suspended from the first drilling device.

12. A method as claimed in claim 1 wherein the drilling device is suspended from the cable via a releasable connection means.

13. A method as claimed in claim 1 wherein the tubing is steel tubing or plastic tubing.

14. A method as claimed in claim 13 wherein the second stream of produced fluid is passed to the drilling device through the annulus formed between the tubing and the wall-of the new section of wellbore and the entrained cuttings stream is transported away from the drilling device through the interior of the tubing.

15. A method as claimed in claim 13 wherein the tubing is steel tubing and the second stream of produced fluid is passed to the drilling device through the interior of the steel tubing and the entrained cuttings stream is transported away from the drilling device through the annulus formed between the steel tubing and die wall of the new section of wellbore ("conventional circulation" mode).

16. A method as claimed in claim 13 wherein the steel tubing is provided with at least one radially expandable packer and after completion of drilling of the new wellbore section, the steel tubing is locked in place in the new wellbore section by expanding the at least one radially expandable packer so that the steel tubing forms a sealed liner for the new wellbore section.

17. A method as claimed in claim 16 wherein the steel tubing is subsequently perforated to allow fluid to flow from the hydrocarbon-bearing zone of the formation into the interior of the liner and into the hydrocarbon fluid production conduit.

18. A method as claimed in claim 13 wherein the steel tubing is expandable tubing and is capable of being passed through the hydrocarbon fluid production conduit in its non-expanded state after completion of the drilling of the new welibore section, is capable of being expanded to form a liner for the new wellbore section.

19. A method as claimed in claim 1 wherein the drilling device is provided with an electrically operated traction means to advance the drilling device and tubing through the new wellbore section as it is being drilled and/or to withdraw the drilling device from the new wellbore section and existing wellbore after completion of the drilling of the new wellbore section.

20. A method as claimed in claim 1 wherein the tubing is steel tubing and a housing is attached either directly or indirectly to the second end of the steel tubing and the interior of the steel tubing is in fluid communication with a passage in the housing.

21. A method as claimed in claim 20 wherein the maximum outer diameter of the housing is less than the inner diameter of the production conduit.

22. A method as claimed in claims 20 wherein the housing attached to the second end of the steel tubing is provided with an electrically operated pumping means either for passing the second stream of produced hydrocarbon through the interior of the steel tubing to the drilling device or for drawing the entrained cuttings stream away from the drilling device through the interior of the steel tubing.

23. A method as claimed in claim 20 wherein the housing attached to the second end of the steel tubing is provided with electric motor for actuating a means for rotating the steel tubing thereby rotating the drilling device so that the culling surfaces on the drilling device drill the new section of wellbore.

24. A method as claimed in claims 20 wherein the housing attached to the second end of the steel tubing is provided with an electrically operated traction means for advancing the steel tubing and hence the drilling device through the new wellbore section as it is being drilled and optionally for withdrawing the steel tubing and hence the drilling device from the new wellbore section.

25. A method as claimed in claim 1 wherein sensors are provided along the cable and along the outside of the tubing for transmitting data to the surface via the electrical conductor wire(s) and/or segmented electrical conductor(s) encased in the cable.

* * * * *